US005577904A

United States Patent [19]

Döbbeling

[11] Patent Number: 5,577,904

[45] Date of Patent: Nov. 26, 1996

[54] METHOD OF OPERATING A PREMIXING BURNER

[75] Inventor: Klaus Döbbeling, Nussbaumen, Switzerland

[73] Assignee: ABB Research Ltd., Zurich, Switzerland

[21] Appl. No.: 414,319

[22] Filed: Mar. 31, 1995

[30] Foreign Application Priority Data

May 20, 1994 [DE] Germany ..... 44 17 769.0

[51] Int. Cl.[6] ..... F23C 5/00

[52] U.S. Cl. ..... 431/8; 431/268; 431/349; 431/353

[58] Field of Search ..... 431/7, 171, 268, 431/354, 349, 346, 347, 10, 350, 353

[56] References Cited

U.S. PATENT DOCUMENTS 2,592,110 4/1952 Berggren et al. ..... 431/349
4,916,904 4/1990 Ramsaier et al. ..... 431/268
5,248,251 9/1993 Dalla Betta et al. ..... 431/7

FOREIGN PATENT DOCUMENTS 2361366 6/1974 Germany .

*Primary Examiner*—James C. Yeung
*Attorney, Agent, or Firm*—Burns, Doane, Swecker & Mathis

[57] ABSTRACT

In a premixing burner (1) which essentially consists of a mixing section (3) and a downstream combustion section (13), an ignition zone (9) being placed intermediately between the two sections, a fuel (5) and combustion air (4) are introduced at the head side of the mixing section (3) to form a mixture. At the end of the mixing section (3), the fuel/air mixture (6) ignites in the region of the ignition zone (9), specifically in such a way that no backflow zone is formed on the axis (12) of symmetry. Self-ignition and flashback are prevented by the high velocity of the mixture (6) in the mixing section (3). A conical reaction zone (11) is produced by the temperature differences between wall boundary layer and core of the hot-gas flow (15) inside the combustion section (13).

8 Claims, 1 Drawing Sheet

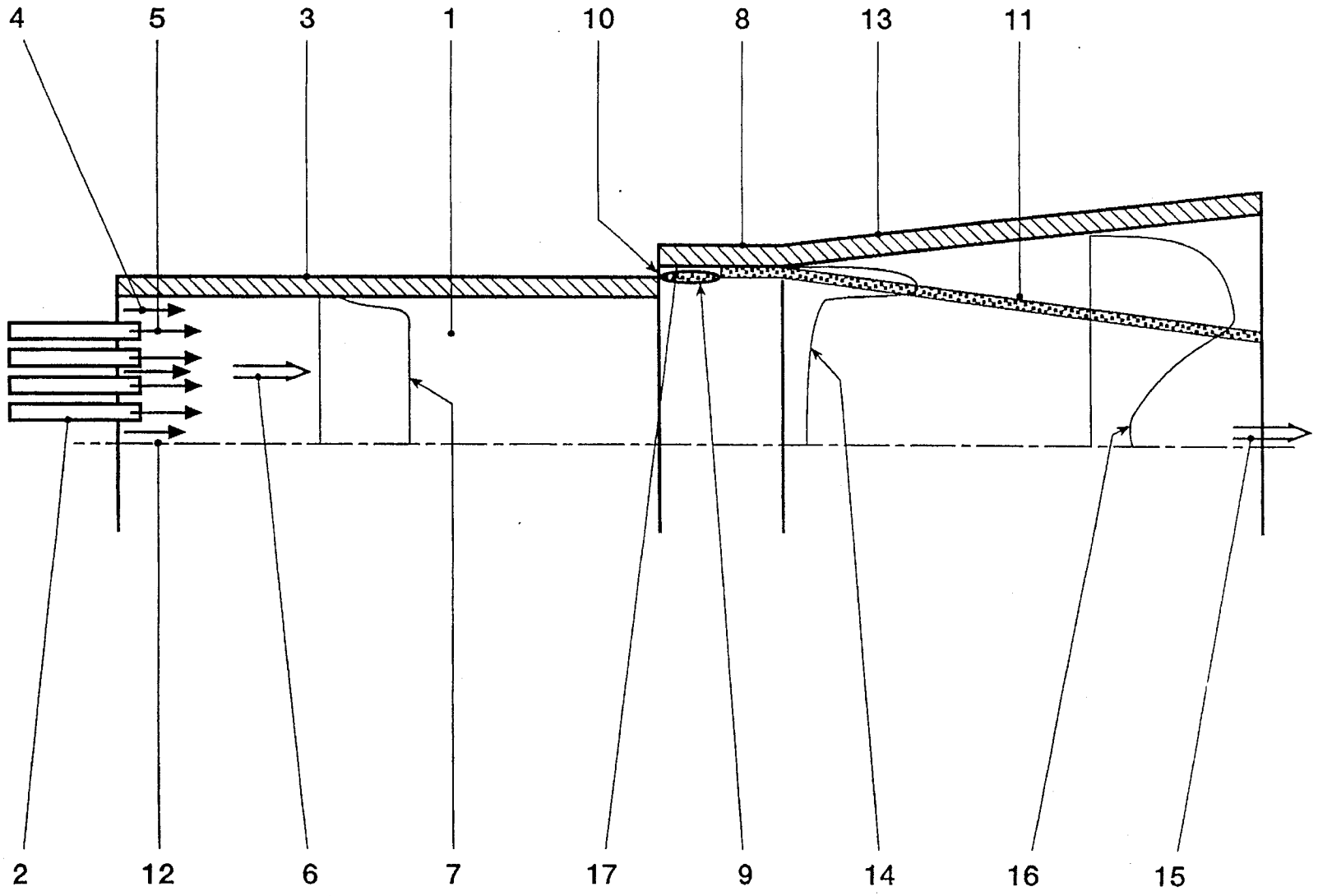
4
5
3
1
10
8
13
11
2
12
6
7
17
9
14
16
15

METHOD OF OPERATING A PREMIXING BURNER

FIELD OF THE INVENTION

The present invention relates to a method of operating a premixing burner for self-ignition of a fuel. It also relates to a premixing burner for carrying out the method.

BACKGROUND

Combustion with extremely low pollutant content for lean premixing flames can be achieved if the reaction zone is spread spatially to a considerable degree if no rapid back mixing of exhaust gas with the fresh gas mixture is effected. This was achieved, inter alia, by experiments with perfect premixing and catalytic flame retention baffles as well as with flame retention baffles in the center of a premixed flow. NOx emission values of about 5 ppm (15% O2) at 1750° K. (1477° C.) flame temperature and at a pressure of about 14 bar can be achieved by such a configuration. However, these flame baffles have operational difficulties. On the one hand their cooling is very problematic. On the other hand the mechanical connection between the flame retention baffle and the burner is often responsible for hot zones of the flame retention baffles facilitate the formation of ignition centers. The ignition centers cause a burn-through of these flame retention baffles, which constitutes a potential risk for the downstream turbine. Several attempts have been made by means of clamping devices to prevent the flame retention baffles from becoming detached. But the play especially between clamping device and body of the flame retention baffle offers ideal conditions for forming wall boundary layers via which flashback of the flame into the interior of the premixing section is bound to occur.

SUMMARY OF THE INVENTION

Accordingly, one object of the invention in a method and a premixing burner is to stabilize the flame without flame retention baffles and without an intensive backflow zone on the axis.

The fuel admixture at the point of maximum velocity inside the duct forming the premixing burner ensures rapid mixing of the fuel with the combustion air. Neither self-ignition nor flashback can take place inside the mixing section. The mixing section offers a guarantee against flashback without having to revert to a flame retention baffle, in which case no backflow zones arise in the combustion zone. The mixing section can be provided with static mixing elements in order to achieve optimum homogeneity of the premixing.

The essential advantages of the invention are as follows:

Good flame stability with minimum burner pressure loss due to small pulsations.

Very low NOx emissions, less than the strictest environmental protection regulation, which at present are around 9 ppm.

Good partial-load behavior.

Low fuel supply pressure required.

The invention is also especially suitable for fuels containing hydrogen, since the fuel rich central zones in the mixing section also have extremely high flow velocities, and the wall boundary layers always have a low fuel content. The invention is also suitable for bringing about the combustion of liquid fuels, since pre-evaporation takes place in the mixing section without wetting of the wall.

A further advantage can be seen in the fact that the hot wall in the area of the reaction zone is simple to cool.

Advantageous and convenient further developments of the achievement of the object according to the invention are defined in the further dependent claims.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein the single FIGURE shows a premixing burner in half section.

DETAILED DESCRIPTION

Referring now to the drawing, wherein all elements not required for directly understanding the invention have been omitted and the direction of flow of the media is indicated by arrows, the FIGURE shows a premixing burner 1 which has the shape of a straight duct. A mixing tube 3 forms the first portion of the burner 1. A fuel 5, preferably a gaseous fuel, is injected on the head side of this duct by a plurality of injectors 2. The high velocity of the combustion air 4 inside the mixing tube 3 ensures that neither self-ignition nor flashback can take place inside the mixing section: The length of the mixing section can be calculated with known correlations from the literature. Additional mixing elements (not shown) of static type can be used in the mixing tube 3 to improve the homogeneity of the mixture. Flashback within the wall boundary layer is not possible because the fuel/air mixture 6 is rather lean at the wall due to the centrally arranged fuel injectors 2. The mixture 6 very quickly attains a stabilized axial velocity profile 7 inside the mixing tube 3. Located downstream of the mixing tube 3 as an extension of the duct is a relatively short ignition zone 9; the wall 8 bounding the ignition zone 9 is not cooled, that is, it has a relatively high temperature. This hot point initiates the reaction inside the viscous sublayer. In addition, this hot point can be heated by external means, for example electrically. Furthermore, the temperature of the wall 8 of the ignition zone 9 can also be prepared and maintained with the heat from the combustion during operation by adequate insulation on the outside of the wall 8. A catalytic coating 17, for example a platinum coating, which has a very advantageous effect on the stability of the flame formation, can easily be added to the surface of the wall 8 facing the inside in the region of the ignition zone 9. To assist flame stability in this zone 9, a small step increasing the cross-section can be built into the duct. This jump 10 in cross-section provides for a stabilizing effect for the flame front in the ignition region 9, that is, in the plane of the flame formation, which effect can be attributed to formation of a pressure drop in this widened zone. Due to the turbulence caused by the wall boundary layer and due to the Kelvin-Helmholtz instability between hot boundary layer and cold core of the flow, the reaction zone 11 progresses rapidly in a conical fashion up to the axis 12 of symmetry of the premixing burner 1. Following downstream of the wall 8 of the ignition zone 9 is a combustion section 13. The wall of the combustion section 13 is preferably cooled and has a diffuser-like or an impulse-diffuser-like widened portion. The combustion section 13 widens over its length to about two and a half times the initial cross-sectional area which helps to keep the flow velocity roughly constant and to keep down the pressure loss as well as the thermal stress on this wall. The mixture can additionally be intensified downstream of the jump 10 in cross-section by superimposing a slight swirl in the flow by means (not shown) before the addition of fuel, although this is to be done without vortex breakdown. The intensification is a consequence of the destabilizing effect of a radial density stratification having a negative gradient in a rotational flow field. The temperature profile 14 at the start of the combustion section 13 is closely orientated to the course of the reaction zone 11: the jump in temperature toward the core of the hot gases 15 is considerable here. However, the temperature profile 16 smooths out considerably further downstream in such a way that a large part of the hot-gas flow 15 has a uniform temperature. Only in the core is a small jump in temperature still to be expected. During partial load, the mixture can be enriched via bores (not shown) about the periphery of the mixing tube 3, that is upstream of the ignition zone 9, whereby up to 70% partial load can be achieved. The premixing burner 1 can be operated both with low-calorific fuels and natural gas and with hydrogenous gases and heating oils. Furthermore, the premixing burner 1 can be used as a stage of a multi-stage combustion apparatus. To stabilize the flame, the wall 8 of the ignition zone 9 is to remain uncooled, as already mentioned above. A suitable material here is a ceramic.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a premixing burner which comprises a mixing section with an upstream head side and a downstream combustion section, and an ignition zone having a heated wall section to initiate self-ignition of a fuel being located intermediately between the two sections, the method comprising the steps of:

introducing a fuel and combustion air at the head side of the mixing section to form a mixture, and, allowing the mixture to flow to the ignition zone for self-ignition of the mixture, wherein the mixture is given a flow velocity inside the mixing section sufficiently high so that both self-ignition of the mixture and flashback from the ignition zone are prevented, and wherein ignition of the fuel initiated by the heated wall section forms in the flow a hot wall boundary layer and a colder core flow inside the combustion section wherein a conical shaped reaction zone forms which converges in the direction of flow toward a central flow axis of the premixing burner.

2. The method as claimed in claim 1, wherein the burner includes a radially outward step at a junction of the mixing section and the wall of the ignition zone increasing the a cross-sectional area in the burner, the step being of such size that allowing the mixture to flow to the ignition zone produces a flame front to form at the ignition zone without a backflow zone on the axis of symmetry.

3. A premixing burner for for self-ignition of a fuel, the premixing burner having an axial flow direction, and comprising:

a mixing section having an outer wall defining a flow cross-sectional area, a downstream combustion section having an outer wall defining a flow cross-sectional area greater than that of the mixing zone, an ignition zone located intermediately between the mixing section and the combustion section the ignition zone having a heat-retaining wall for initiating self-ignition of a fuel, and a radially outward jump connecting the outer wall of the mixing section and the wall of the ignition zone, the jump being of sufficient size to produce a low pressure region without the formation of vortices in the flow at the ignition zone wall.

4. The premixing burner as claimed in claim 3, wherein the wall of the ignition zone has a catalytic coating on an inside surface.

5. The premixing burner as claimed in claim 3, wherein the combustion section has a diffuser-like widened portion.

6. The premixing burner as claimed in claim 3, wherein the combustion section has an impulse-diffuser-like widened portion.

7. The premixing burner as claimed in claim 5, wherein a cross-sectional area of the combustion section at an outlet end of the premixing burner is two and a half times a cross-sectional area at the ignition zone.

8. The premixing burner as claimed in claim 6, wherein a cross-sectional area of the combustion section at an outlet end of the premixing burner is two and a half times a cross-sectional area at the ignition zone.

* * * * *